United States Patent [19]

Boyama

[11] 4,170,207

[45] Oct. 9, 1979

[54] IGNITION SYSTEM FOR A MULTICYLINDER INTERNAL COMBUSTION ENGINE

[75] Inventor: Kimihiro Boyama, Numazu, Japan

[73] Assignee: Kokusan Denki Co., Ltd., Numazu, Japan

[21] Appl. No.: 807,114

[22] Filed: Jun. 16, 1977

[30] Foreign Application Priority Data

Jun. 21, 1976 [JP] Japan ..... 51/73037

[51] Int. Cl.[2] ..... F02P 5/00; F02P 1/00

[52] U.S. Cl. ..... 123/148 CC

[58] Field of Search ..... 123/146.5 A, 148 CC, 123/148 CB, 148 E

[56] References Cited

U.S. PATENT DOCUMENTS

| | | | |
|---|---|---|---|
| 3,418,989 | 12/1968 | Silverman | 123/148 E |
| 3,587,550 | 6/1971 | Zechlin | 123/148 CC |
| 3,861,368 | 1/1975 | Dogadko | 123/148 CB |
| 3,880,132 | 4/1975 | Whatley | 123/148 CC |
| 3,896,780 | 7/1975 | Kondo | 123/148 E |
| 4,015,564 | 4/1977 | Fitzner | 123/148 CC |

*Primary Examiner*—Ronald B. Cox

*Attorney, Agent, or Firm*—Pearne, Gordon, Sessions, McCoy & Granger

[57] ABSTRACT

An ignition system for a multicylinder internal combustion engine comprising a turn-on signal source for producing a turn-on signal a plurality of times per revolution of the engine output shaft, a plurality of trigger signal sources each producing a trigger signal once per revolution, and a plurality of gate circuits enabled by the trigger signal to permit the application of the turn-on signal to the associated one of a plurality of capacitor discharge ignition circuits. Thus each ignition circuit operates once per revolution. The turn-on signal is produced at angles varying with the engine speed, and various ignition angle characteristics can be obtained.

5 Claims, 8 Drawing Figures

IGNITION SYSTEM FOR A MULTICYLINDER INTERNAL COMBUSTION ENGINE

BACKGROUND OF THE INVENTION

The present invention relates to a capacitor discharge ignition system for a multicylinder internal combustion engine.

A conventional capacitor discharge ignition system for a multicylinder internal combustion engine necessitates an exciter coil for charging the capacitor and a signal coil for supplying a turn-on signal to a thyristor which enables discharge of the capacitor. The exciter coil and the signal coil are provided in a multipolar magneto AC generator driven by the engine. The signal coil provided in a multipolar generator produces a turn-on signal a plurality of times during one revolution of the crank shaft of the engine so that a spark occurs at the ignition plug of each cylinder a plurality of times per revolution of the crank shaft. The fact that a spark occurs a plurality of times per revolution is particularly undesirable with a four-cycle engine because such occurrence will reduce the engine output. Another conventional ignition system employs a special signal source which is adapted to produce a signal once per revolution. However, signal output produced by such a signal source is of a short duration, so that it places a limitation to the range of ignition angle variation with engine speed which is often required.

SUMMARY OF THE INVENTION

An object of the present invention is to provide an ignition system wherein a spark occurs once per revolution of the engine, thereby avoiding reduction of the engine output while the range of ignition angle variation can be made sufficient.

An ignition system according to the present invention comprises first to n-th (n being an integer greater than unity) ignition coils respectively provided in conjunction with first to n-th cylinders of the multi-cylinder internal combustion engine, first to n-th capacitors respectively provided on the primary sides of the first to n-th ignition coils, at least one power source for charging the first to n-th capacitors, and first to n-th semiconductor switches with a control terminal provided on the primary sides of said ignition coils and adapted to be turned on for discharging the capacitors through the first to n-th primary windings of the first to n-th ignition coils. The ignition system is characterized by further comprising a turn-on signal source for providing a turn-on signal at least n times per revolution of the engine output shaft at the rotational angles at which ignition is expected in any of the cylinders, first to n-th trigger signal sources for providing a trigger signal in sequence, each of the trigger signal sources being adapted to generate a trigger signal in advance of the maximally advanced ignition angle of the associated one of the first to n-th cylinders, and first to n-th gate circuits, each being adapted to be opened upon receipt of the trigger signal from the associated one of the trigger signal sources to enable the turn-on signal to be applied to the associated one of the semiconductor switches. The turn-on signal source may comprise a signal coil provided in an AC generator rotating in synchronism with the engine to generate an AC signal of a relatively long duration. The combination of the gate circuits, the trigger signal sources and the turn-on signal sources makes it possible to cause ignition only once per revolution of the engine output shaft. The turn-on signal source is capable of producing a turn-on signal at an angle varying with engine speed, and as a result various ignition angle characteristics as desired can be readily obtained.

BRIEF DESCRIPTION OF THE DRAWINGS

Other features and advantages of the present invention will be apparent from the following description taken in conjunction with the accompanying drawings in which.

DETAILED DESCRIPTION OF THE PREFERRED EMBODIMENTS

Although the invention is applicable to an ignition system having n(n being any integer greater than unity) cylinders, for the sake of simplicity, the following description will be made with reference to an engine with three cylinders.

Figure 1:
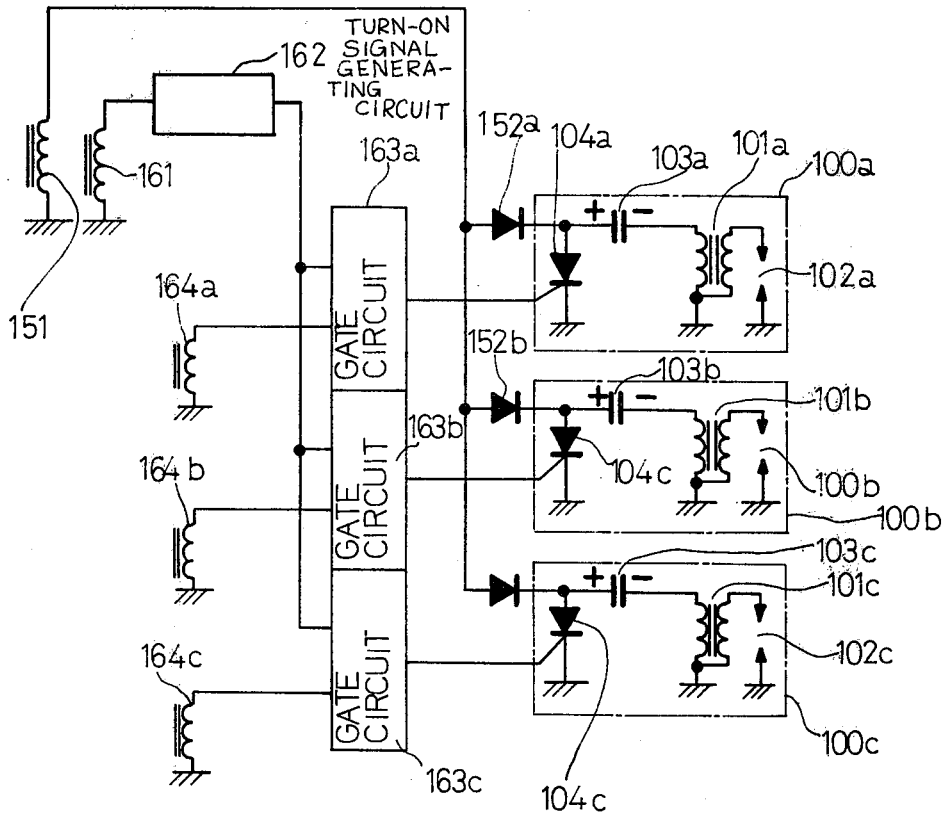
FIG. 1 schematically shows the general construction of an embodiment of the present invention.

FIG. 1 schematically shows the general construction of an ignition system according to the present invention. The ignition system comprises first to third ignition coils **101*a*–101*c* provided in conjunction with first to third cylinders, not shown, and first to third ignition plugs 102*a*–102*c* connected to the secondary of the ignition coil 101*a*–101*c*. The primary windings of the ignition coils 101*a*–101*c* have first ends thereof grounded and second ends connected to first terminals of first to third capacitors 103*a*–103*c*. Second terminals of the capacitors 103*a*–103*c* are respectively connected to the anodes of the thyristor 104*a*–104*c*, whose cathodes are grounded. Thus, the ignition coils 101*a*–101*c*, the capacitors 103*a*–103*c* and the thyristors 104*a*–104*c* form first to third capacitor discharge ignition circuits 100*a*–100*c*. Operation of each of the capacitor discharge ignition circuits comprises, as is known in the art, charging of each of the capacitors by a power source which will be described later, and turn-on of each of the thyristors 104*a*–104*c*** for discharging the capacitor through the primary of the associated ignition coil, the discharge inducing a high voltage in the secondary and therefore firing of the ignition plug.

The ignition circuits **100*a*–100*c* are associated with a power source and turn-on signal source. In the embodiment illustrated, the power source comprises an exciter coil provided in an AC generator which is driven to rotate in synchronism with the engine, the output of the exciter coil being applied through each of first to third diodes 152*a*–152*c* across each of the series connection of the capacitors 103*a*–103*c* and ignition coils 101*a*–101*c*, to charge the capacitors into the polarity as indicated by "+" and "−" in FIG. 1. The turn-on signal source of the embodiment comprises a signal coil 161 also provided in the same generator as the exciter coil 151. The signal coil 161 is designed to produce a signal output of at least 3 cycles (3 being the same number as the number of the cylinders of this embodiment) per revolution of the output shaft of the engine. The output of the signal coil 161 is supplied to a turn-on signal generating circuit 162. The turn-on signal generating circuit 162 preferably generates a turn-on signal once per cycle of the output of the signal coil. The turn-on signal is supplied through first to third gate circuits 163***a*–163*c* to the gates of the thyristors 104*a*–104*c*. To open each of the gate circuits 163*a*–163*c* within selected periods first to third pulser coils 164*a*–164*c* are provided to act as trigger signal sources. Each of the pulser coils generates a signal which is applied to the associated gate circuit once per revolution of the output shaft of the engine at an angle slightly advancing the maximally advanced ignition angle of the cylinder. Each of the gate circuits is constructed to be opened or to be enabled for a predetermined period upon receipt of a trigger signal. The turn-on signal from the turn-on signal generating circuit 162 is supplied through the gate circuit which is being enabled to the associated thyristor. By properly determining the sequence of enabling the gate circuits, and more particularly by opening each of the gate circuits at an angle slightly advancing the maximally advanced ignition angle relative to the top dead center of the piston and closing the gate circuit after the turn-on signal has passed, each cylinder will have a spark caused once per revolution.

The turn-on signal generating circuit 162 is adapted to generate a pulsative turn-on signal when the instantaneous value of the output voltage of the turn-on signal coil exceeds a predetermined level. The amplitude of the output of the signal coil provided in a generator rotating in time with the engine becomes larger with increase of the engine speed, so that the turn-on signal is generated at an angle more advanced with increasing engine speed. The thyristors are therefore turned on at an angle more advanced with increasing engine speed, and consequently ignition angle advance is achieved.

Figure 2:
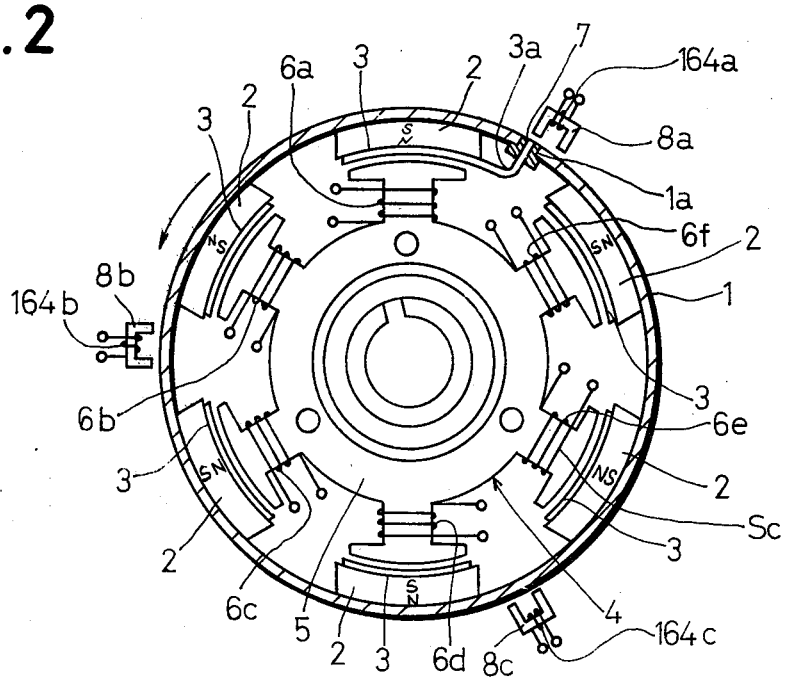
FIG. 2 shows a sectional view showing a preferable example of a generator suitable for the present invention.

The invention will now be described with reference to a specific example. FIG. 2 shows a magneto AC generator suitable for a power source and a turn-on signal source. The generator comprises a substantially cup-shaped flywheel 1 formed of a magnetic material, and arcuate permanent magnets 2,2 . . . mounted and spaced equally from each other on the inner surface of the peripheral wall of the flywheel. The magnets are so polarized that N- and S-poles appear alternately on their inner surfaces. Pole pieces 3,3 . . . are fixed on the inner surfaces. The flywheel, the magnets and the poles pieces form part of a six-polar rotor. The rotor is usually coupled to a crank shaft of the engine. The generator further comprises a stator 4 which comprises a substantially star-shaped core 5 and armature coils 6*a*–6*f*. The stator 4 may be fixed, for instance, to the case of the engine. In the embodiment illustrated, the armature coil 6*a* is utilized as the exciter coil 151, and the armature coil 6*e* which is positioned 120° (mechanical angle) apart from the armature coil 6*a* and which therefore produces an output of the same phase as the coil 6*a* is utilized as the turn-on signal coil 161. The rest of the armature coils 6*b*–6*d* and 6*f* are used to energize head lights of the vehicle and other loads.

The flywheel 1 is provided with an opening 1*a* in the peripheral wall. A spacer 7 of a non-magnetic material is fitted in the opening. One of the pole pieces 3,3 . . . has an extension 3*a* extended first in an direction parallel to the flywheel periphery and then radially outward to penetrate through the spacer 7 and to have the end exposed outside the flywheel. Outside the flywheel are so positioned substantially U-shaped cores 8*a*–8*c* that a pair of legs of each of the cores simultaneously confront the exposed end of the extension 3*a* and the outer surface of the flywheel 1, and that the cores are distanced 120° (mechanical angle) apart from each other. The cores 8*a*–8*c* have pulser coils 164*a*–164*c* mounted thereon respectively.

Figure 3:
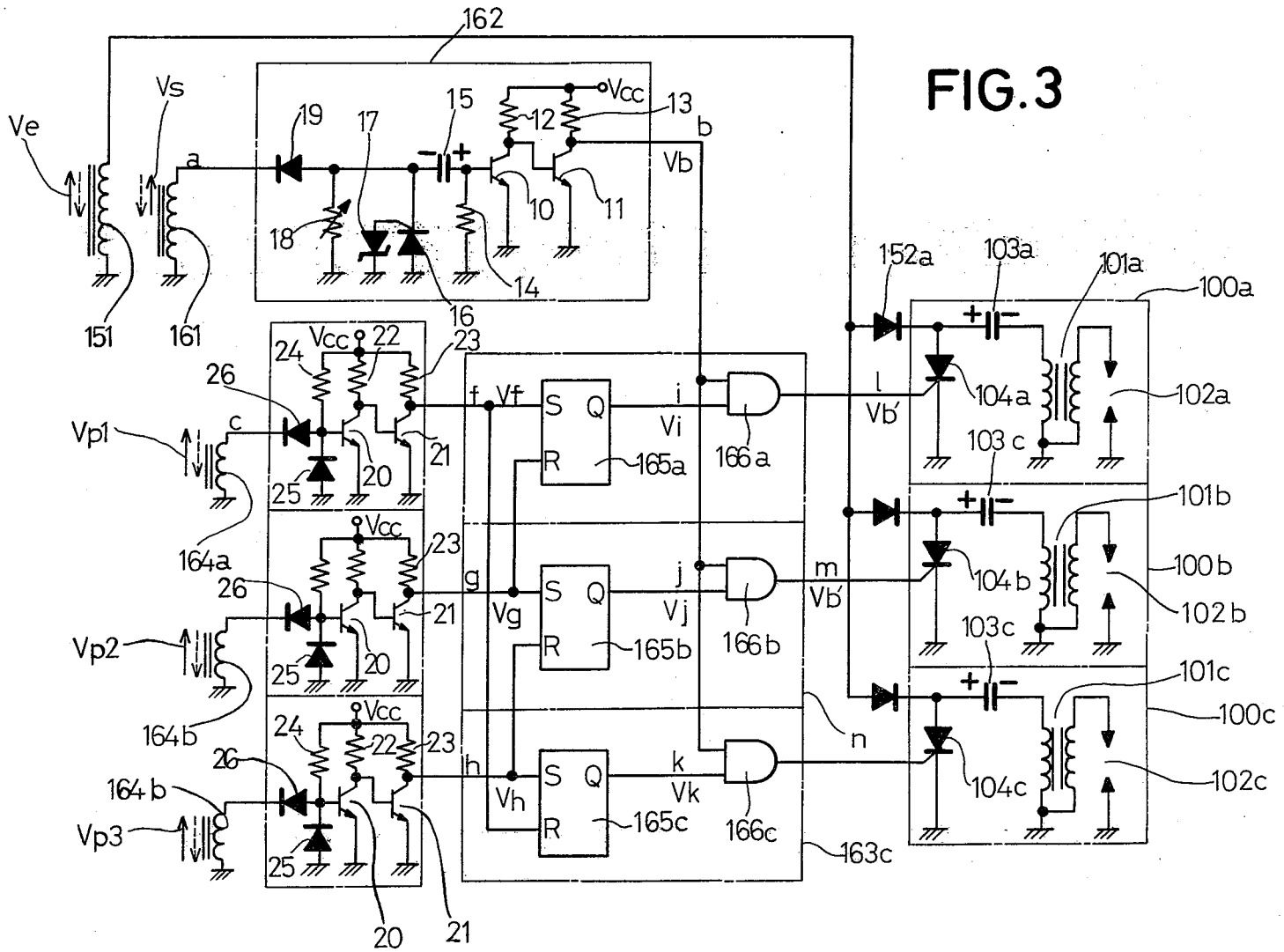
FIG. 3 shows a specific embodiment of the present invention.

FIG. 3 shows a specific example of an ignition system generally shown in FIG. 1, and more particularly the specific construction of the turn-on signal generating circuit 162 and the gate circuits 163*a*–163*c*. The turn-on signal generating circuit 162 comprises a first transistor 10 having its collector coupled through a resistor 12 to a DC power source Vcc, a second transistor 11 having its collector coupled through a resistor 13 to a DC power source Vcc and its base coupled directly to the collector of the first transistor 10, a capacitor 15 having one of its terminals connected to the base of the first transistor 10, a thyristor 16 having its cathode connected to the other terminal of the capacitor 15 and its anode connected to the emitters of the transistors 10 and 11, a Zener diode 17 having its anode and cathode connected respectively to the gate and anode of the thyristor 16, and a variable resistor 18 connected across the cathode and anode of the thyristor 16, and a diode 19 inserted to rectify the output of the signal coil 161 to enable charging of the capacitor 15 into the polarity as indicated by "+" and "−" in FIG. 3.

The gate circuits 163*a*–163*c* comprises first to third flip-flops 165*a*–165*c*, respectively, and AND gates 166*a*–166*c*, respectively, having one of their input terminals coupled to the Q-terminals of the flip-flops, and the other input terminals coupled to receive the turn-on signal from the turn-on signal generating circuit 162. "Rest" terminals R of the first, second and third flip-flops 165*a*–165*c* are coupled to "set" terminal S of the second, third and first flip-flops, respectively.

In the embodiment illustrated, first to third wave shaping circuits 167*a*–167*c* are provided to form part of the trigger signal sources to shape the output voltage from the pulser coils 164*a*–164*c* into pulsative trigger signals. Each of the wave shaping circuits comprises a first transistor 20 having its collector connected through a resistor 22 to a DC power source Vcc and its base connected through a resistor 24 to the DC power source Vcc, a second transistor 21 having its collector connected through a resistor 23 to the DC power source Vcc and its base connected directly to the collector of the first diode, and a diode 25 connected across the base and emitter of the transistor 20. Each of the pulser coils 164*a*–164*c* is connected through a diode 26 across the base and emitter of the first transistor 20.

Figure 4:
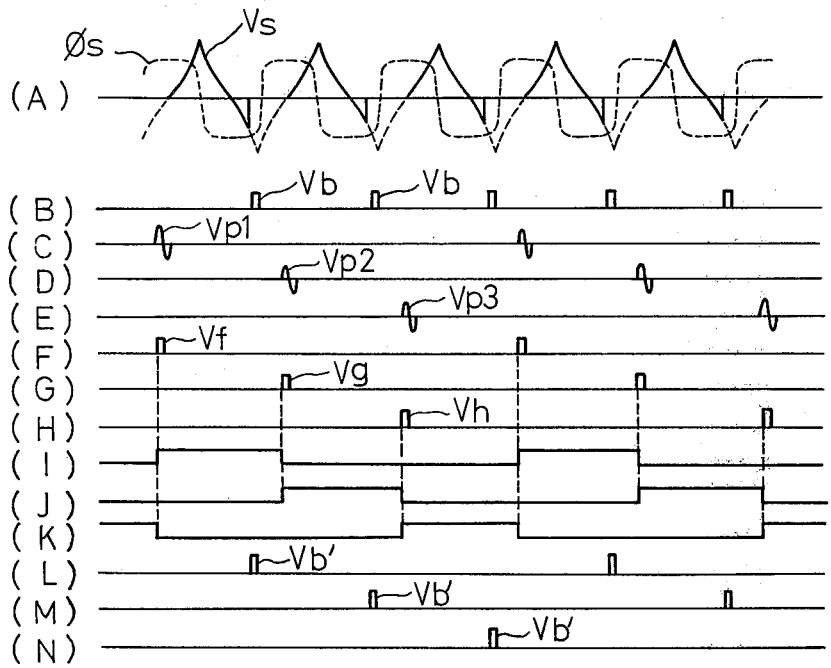
FIGS. 4(A) through (N) show waveforms of the signals at various portions of the system of FIG. 3.

FIGS. 4(A) through (N) show waveforms of the signals appearing at the portions indicated by a through n in FIG. 3. As the flywheel 1 rotates, for instance in a direction shown by the arrow in FIG. 2, the exciter coil 151 induces an AC voltage Ve having a frequency of 3 cycles per revolution. During the positive half cycle of the voltage Ve, current flows through the diodes 152*a*–152*c* and the primary windings of the ignition coils 101*a*–101*c* to charge the capacitor 103*a*–103*c*. During the negative half cycle, the output of the exciter coil 151 is obstructed by the diodes 152a–152c. The signal coil 161 produces a voltage Vs in phase with the exciter coil. The voltage Vs has a waveform as shown in FIG. 4(A). The positive output of the voltage Vs is obstructed by the diode 19. When the negative output is produced, current flows through a path including the resistor 14 and the diode 19 to charge the capacitor 15 into the polarity as indicated by "+" and "−" in FIG. 3. As the voltage across the capacitor 15 exceeds a certain value the Zener diode 16 breaks down and the thyristor 16 is turned on, so that the capacitor 15 is discharged through two paths, one of which includes the resistor 14 and the thyristor 16 and the other of which includes the base and emitter of the transistor 10 and the thyristor 16. The transistor 10 thereby becomes conductive which in turn makes the transistor 11 nonconductive, with the result that the potential at the collector of the transistor 11 rises. When the discharge of the capacitor 15 is completed the transistor 10 becomes nonconductive to make the transistor 11 conductive, so that the collector potential thereof returns to zero (ground potential). Since the discharge of the capacitor 15 is completed within a short period, a voltage obtained across the collector indicated by b of the transistor 11 and the ground during the discharge has a short duration as shown in FIG. 4(B). The voltage Vb is used as a turn-on signal to turn on the thyristors 104a–104c. The angle at which the voltage Vb rises determines the ignition angle.

In the turn-on signal generating circuit 162, the turn-on signal Vb is produced when the output voltage Vs of the signal coil 161 reaches a certain level necessary to turn on the Zener diode 17.

Figure 5:
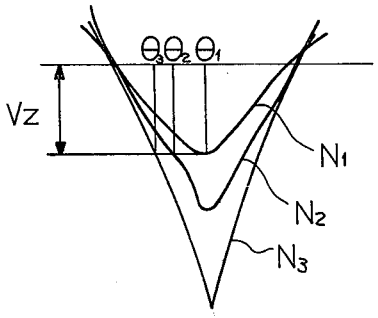
FIG. 5 shows part of waveforms illustrative of angle advance of the system of FIG. 3.
Figure 6:
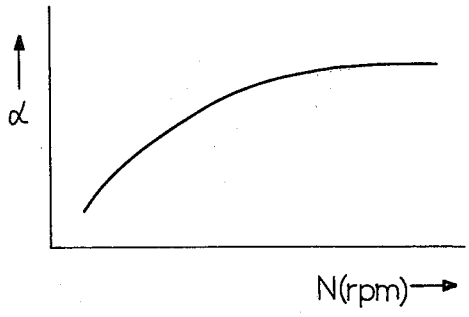
FIG. 6 shows an example of angle advance characteristic obtained by the system of FIG. 3.

As is shown in FIG. 5, as the engine speed is increased from $N_1$ to $N_2$, and to $N_3(N_1<N_2<N_3)$ the angle at which the signal Vb is produced advances from $\theta_1$ to $\theta_2$, and to $\theta_3$. Since the signal Vb determines the angle at which the thyristors 104a–104c conduct, the advance angle in relation to the top dead center of the piston advances with the engine speed as shown in FIG. 6.

In the arrangement of FIG. 3, the pulser coils 164a–164c produce trigger signals $V_{p1}$–$V_{p3}$, as in FIGS. 4(C)–(E), having short duration at angles in advance of the ignition angles of the associated cylinders. The signals $V_{p1}$–$V_{p3}$ are shaped in the wave shaping circuits 167a–167c. More particularly, when each of the pulser coils produces a positive output indicated by arrows of a solid line, the diode 26 is reverse-biased and the transistor 20 is provided with a base current through the resistor 24 and thereby becomes conductive with the result that the transistor 21 becomes nonconductive, so that the collector potential of the transistor rises. While each of the pulser coils produces no output or negative output the base and emitter of the transistor 20 is effectively shunted, so that the transistor 20 remains nonconductive and the collector potential of the transistor 21 remains at zero. Consequently, the wave shaping circuits 167a–167c produce pulsative signals Vf-Vh as shown in FIGS. 4(F)–(H) while the pulser coils produce positive output. As the pulsative signal is applied to set terminal to either of the flip-flops 165a–165c, the flip-flop which has been set will have the potential at its Q terminal rise to serve as an enabling signal to be supplied to the AND gates.

The flip-flops 165a, 165b and 165c are respectively reset by set signals of the flip-flops 165b, 165c and 165a. As is shown in FIGS. 4(I)–(K) each flip-flop therefore produces an enabling signal for 120° (in mechanical angle) starting at an angle when the associated pulser coil supplies a set signal and ending when the adjacent flip-flop is subsequently set. Each of the AND gates 166a–166c produces output only when it concurrently receives the enabling signal from the associated flip-flop and the turn-on signal Vb. Consequently, each of the thyristor 104a–104c receives a gate signal once per revolution as shown in FIGS. 4(L)–(N), and ignition is effected once per revolution. Since the turn-on signal Vb is provided at more and more advanced angle with increasing engine speed, the ignition angle of each cylinder advances with increasing engine speed as shown in FIG. 6.

It has been described above that the ignition system has an ignition angle characteristic wherein ignition angle simply advances with engine speed. However, the invention is not limited to the embodiment described above, but is applicable to ignition systems having various ignition angle characteristics. For examples, the ignition angle may be retarded with increasing engine speed by having the output of the signal coil shunted to postpone the charging of the capacitor 15, or by inserting a phase shifting circuit between the turn-on signal coil and the turn-on signal generating circuit.

Each of the gates 163a–163c may be composed differently from that shown in FIG. 3, and may comprise any device which opens at an angle slightly advancing the maximally advanced angle of each cylinder and closes in advance of the ignition angle of each cylinder. For example, in place of the flip-flop as in FIG. 3, a monostable multivibrator may be employed.

Figure 7:
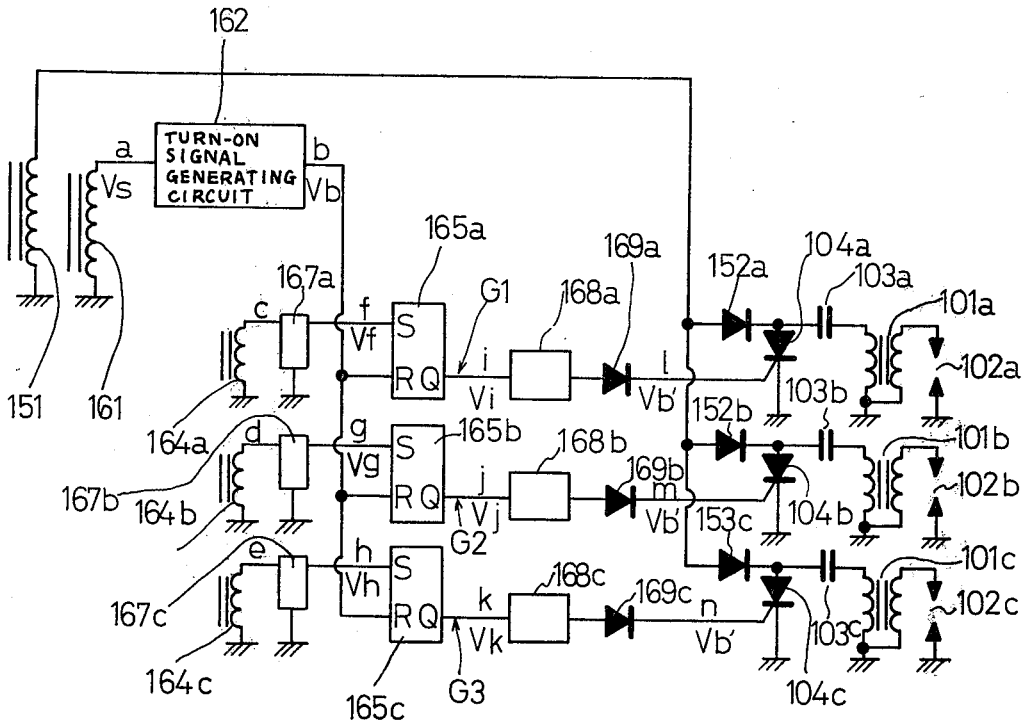
FIG. 7 shows another embodiment of the invention.
Figure 8:
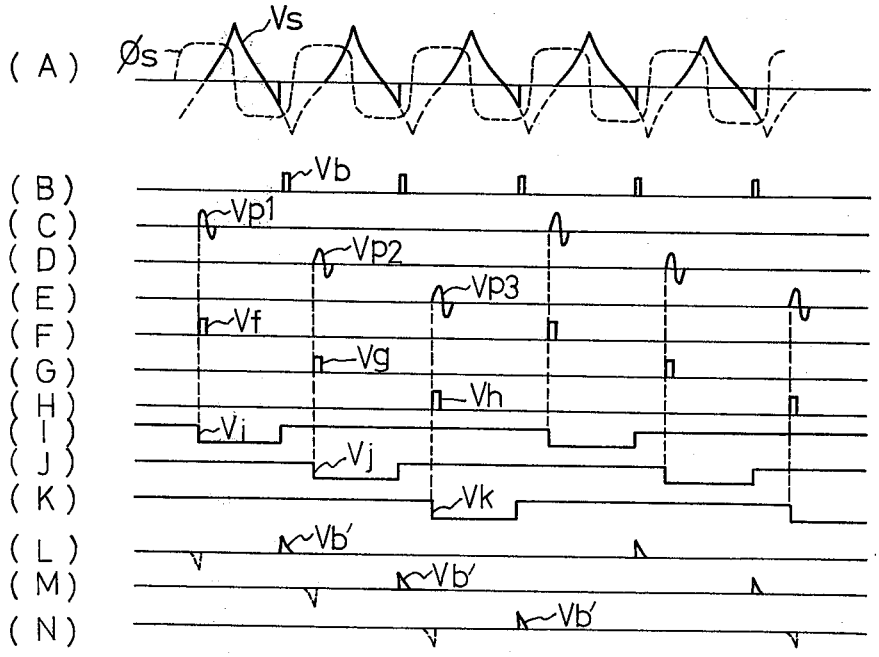
FIGS. 8(A) through (N) show waveforms of signals at various portions of the system of FIG. 7.

As can been seen in FIG. 7, the output of the signal generating circuit 162 may be supplied to reset terminals R of the flip-flops 165a–165c, and the output at the Q terminals may be transferred to differentiation circuits 168a–168c, and further to diodes 169a–169c. This arrangement eliminates the AND gates of FIG. 3. The waveforms of the signals at various portions a through n of the arrangement of FIG. 7 are shown in FIGS. 8(A)–(N).

In the embodiments described above, the output of the signal coil 161 is supplied to the turn-on signal generating circuit 162 and converted to a pulsative signal there. The output of the signal coil 161 may alternatively be supplied directly to the gate circuits 163a–163c, and further to the thyristors 104a–104c.

In the embodiments described, the thyristors 104a–104c are used to enable the discharge of the capacitors 103a–103c. It should however be noted that any type of semiconductor switches such as transistors may be used.

In the embodiments described, the exciter coil 151 is used as a power source for charging the capacitors, but the invention is also applicable to a system employing batteries as the power source.

In the embodiments described, the signal generator shown in FIG. 2 is used as part of the trigger signal sources, but those skilled art will readily appreciate that other types of signal generators may be substituted. An example of a known type of signal generator is one having an inductor which causes variation of the magnetic flux interlinking with pulser coils.

The wave shaping circuits 167a–167c may be omitted so that the output of the pulser coils is supplied directly to the gates 163a–163c.

It should also be noted that the positioning of the capacitors 103a–103c and the thyristors 104a–104c may be reversed; that is, the capacitors may be positioned where there are thyristors in FIG. 1 and the thyristors may be positioned where there are capacitors in FIG. 1.

While there have been described what are at present considered to be the preferred embodiments of the present invention, it will be obvious to those skilled in the art that various changes and modifications may be made therein without departing from the invention, and it is aimed, therefore, in the appended claims to cover all such changes and modifications as fall within the true spirit and scope of the invention.

What is claimed is;

1. An ignition system for a multicylinder internal combustion engine comprising first to n-th (n being an integer greater than unity) ignition coils respectively provided in conjunction with first to n-th cylinders of the engine, first to n-th capacitors respectively provided on the primary sides of said first to n-th ignition coils, at least one power source for charging said first to n-th capacitors, first to n-th semiconductor switches with a control terminal respectively provided on the primary sides of said first to n-th ignition coils and respectively adapted to be turned on for discharging said first to n-th capacitors through the first to n-th primary windings of said first to n-th ignition coils, a turn-on signal source for producing a turn-on signal for turning on said semiconductor switches at least n times per revolution of the output shaft of the engine at the rotational angles at which ignition is expected in any of the cylinders, first to n-th trigger signal sources for providing a trigger signal in sequence, each of said first to n-th trigger signal sources being adapted to generate a trigger signal at an angle in advance of the maximally advanced ignition angle of the associated one of said first to n-th cylinders, and first to n-th gate circuits, each being adapted to be opened upon receipt of the trigger signal from the associated one of said first to n-th trigger signal sources to enable the turn-on signal to be applied to the associated one of said semiconductor switches, characterized in that each of said first to n-th gate circuits comprises a flip-flop adapted to be set upon receipt of a trigger signal from the associated one of said trigger signal sources to produce an output signal for enabling the turn-on signal to be applied to the associated one of said semiconductor switches.

2. An ignition system as set forth in claim 1, wherein the flip-flop of each of said gate circuits is adapted to be reset when the adjacent one of said trigger signal sources subsequently produces a trigger signal.

3. An ignition system as set forth in claim 2, wherein each of said gate circuits comprises an AND gate having two input terminals and for receiving at one of said input terminals the turn-on signal provided by said turn-on signal source and at the other terminal the output signal from the flip-flop in the same gate circuit.

4. An ignition system as set forth in claim 1, wherein the flip-flop of each of said gate circuits is adapted to be reset when said turn-on signal source provides a turn-on signal.

5. An ignition system as set forth in claim 4, wherein each of said gate circuit comprises a differentiation circuit adapted to receive the output signal from the associated flip-flop and to produce a pulsative signal when the associated flip-flop is reset.

* * * * *